United States Patent [19]

Manlowe et al.

[11] Patent Number: 5,066,428

[45] Date of Patent: Nov. 19, 1991

[54] FOAM GENERATING APPARATUS

[75] Inventors: David Manlowe; Paul A. Kittle, both of West Chester, Pa.

[73] Assignee: Rusmar Incorporated, West Chester, Pa.

[21] Appl. No.: 564,368

[22] Filed: Aug. 8, 1990

[51] Int. Cl.[5] ..... B01F 3/04

[52] U.S. Cl. ..... 261/29; 261/DIG. 26

[58] Field of Search ..... 261/36.1, DIG. 26, 29

[56] References Cited

U.S. PATENT DOCUMENTS

| | | | |
|---|---|---|---|
| 3,466,873 | 9/1969 | Present | 405/128 |
| 3,512,761 | 5/1970 | O'Reagan et al. | 261/DIG. 26 |
| 3,740,320 | 6/1973 | Arthur | 261/36.1 |
| 4,157,427 | 6/1979 | Ferber | 261/DIG. 26 |
| 4,246,230 | 1/1981 | Hasselman, Sr. | 261/DIG. 26 |
| 4,371,096 | 2/1983 | Scholl et al. | 261/DIG. 26 |
| 4,421,788 | 12/1983 | Kramer | 427/136 |
| 4,474,680 | 10/1984 | Kroll | 261/DIG. 26 |
| 4,519,388 | 5/1985 | Schwanbom et al. | 128/204.25 |
| 4,956,080 | 9/1990 | Josefik | 261/29 |

*Primary Examiner*—Tim Miles

*Attorney, Agent, or Firm*—Howson and Howson

[57] ABSTRACT

A foam generating apparatus is disclosed which generates foam from a foamable liquid by pumping the liquid by means of a high pressure pump from a storage tank to a combining device in which the liquid is combined with compressed air. The apparatus is capable of both operation and storage under extremely cold ambient conditions without the components of the apparatus becoming frozen. When the apparatus is not generating the product foam, a foamable liquid is recirculated throughout the apparatus to prevent the components of the apparatus from becoming frozen. The recirculation system is especially useful in preventing the high pressure pump from becoming frozen during storage in cold environments, while also reducing the amount of wear on the pump.

11 Claims, 3 Drawing Sheets

FOAM GENERATING APPARATUS

BRIEF SUMMARY OF THE INVENTION

This invention relates to a foam generating apparatus for use in producing a foam product by combining air with a foamable liquid. In particular, the invention relates to a foam generating apparatus capable of recirculating the foamable liquid throughout the apparatus when the foam product is not being produced in order to prevent the components of the apparatus from freezing in cold environments.

Typically, operators of waste landfill areas are required to cover the surface of the landfill with a layer of topsoil at the end of each working day in order to prevent the egress of odors and noxious fumes, and to prevent the ingress of birds, insects, and rodents. Each application of topsoil to the surface of the landfill effectively eliminates many inches of usable fill space. Advances have been made wherein a foam instead of a soil layer is applied to the landfill surface in order to provide effective odor control while eliminating the consumption of valuable fill space. The foam generating apparatus of the instant invention is especially suitable for use in applying a foam product to the surface of a waste landfill area.

Examples of typical foam generating apparatuses known heretofore are described in U.S. Pat. No. 3,466,873 to Present, and in U.S. Pat. Nos. 4,421,788 and 4,519,388 to Kramer et al.

In order to prevent the foamable liquid from freezing within the conventional apparatus during long periods of storage, it is sometimes necessary to remove therefrom any foamable liquid remaining in the apparatus. This can be accomplished by purging the apparatus with air. However, air cannot be allowed to enter the foamable liquid storage tank since premature foam generation may occur within the tank. Furthermore, air cannot be allowed to enter the liquid pumps since air is likely to become trapped within the inner workings of the pump and cause pump cavitation upon start-up. Pump cavitation is known to reduce the efficiency and performance of pumps and should be avoided. Also, air may not be capable of purging all of the foamable liquid from the inner workings of the pump thus permitting any remaining liquid to freeze in the pump when exposed to cold environments.

Therefore, there is a need in the industry to provide an apparatus capable of generating a foam product which can be used in landfill operations, or other operations such as long term fugitive dust control, odor control on both liquid and solid substrates, and especially an apparatus capable of both operation and storage in extremely cold environments without the foamable liquid freezing in the apparatus.

The principal object of this invention is to provide a foam generating apparatus capable of being operated and stored in cold environments without the foamable liquid freezing within the apparatus.

A further object of the invention is to provide a foam generating apparatus having recirculation means which operate when the foam apparatus is not producing foam, and which prevents the foamable liquid of the foam product from freezing within the apparatus.

In accordance with the instant invention, these objects are addressed by a foam generating apparatus in which a foamable liquid is transferred from a storage tank by a pump through valve means to combining means wherein it is combined with compressed air to produce the foam product. The valve means has a first selectable position for permitting the flow of the foamable liquid from the pump to the combining means, and has a second selectable position for preventing the flow of the foamable liquid from the pump to combining means while permitting the flow of the foamable liquid from the pump through a return stream back to the storage tank.

DETAILED DESCRIPTION

Figure 1:
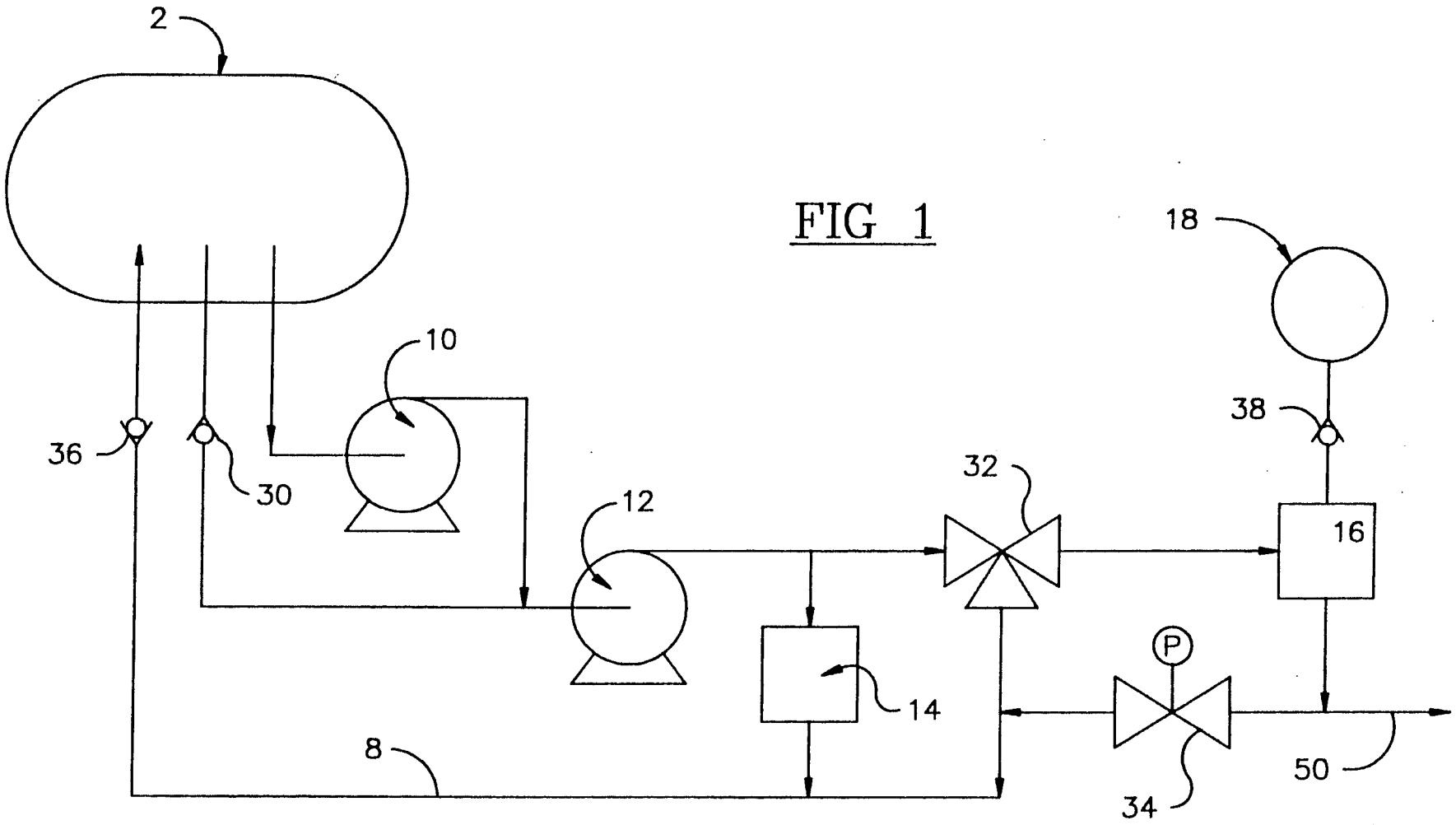
FIG. 1 is a schematic view of a preferred embodiment of the foam generating apparatus of the invention.

FIG. 1 shows a preferred embodiment of the invention which comprises storage tank 2, recirculation pump 10, high pressure pump 12, pressure regulator 14, foam block 16, and air compressor 18. Storage tank 2 stores a foamable liquid. During normal operation, high pressure pump 12 delivers a large portion of its output of foamable liquid to foam block 16, while delivering the remaining portion of its output of foamable liquid to pressure regulator 14. Foam block 16 combines the foamable liquid from pump 12 with compressed air from air supply 18 to produce the desired product foam. During a storage condition, pump 12 is inactivated and recirculation pump 10 is activated to deliver the foamable liquid from tank 2, through pump 12, and back to tank 2.

Figure 2:
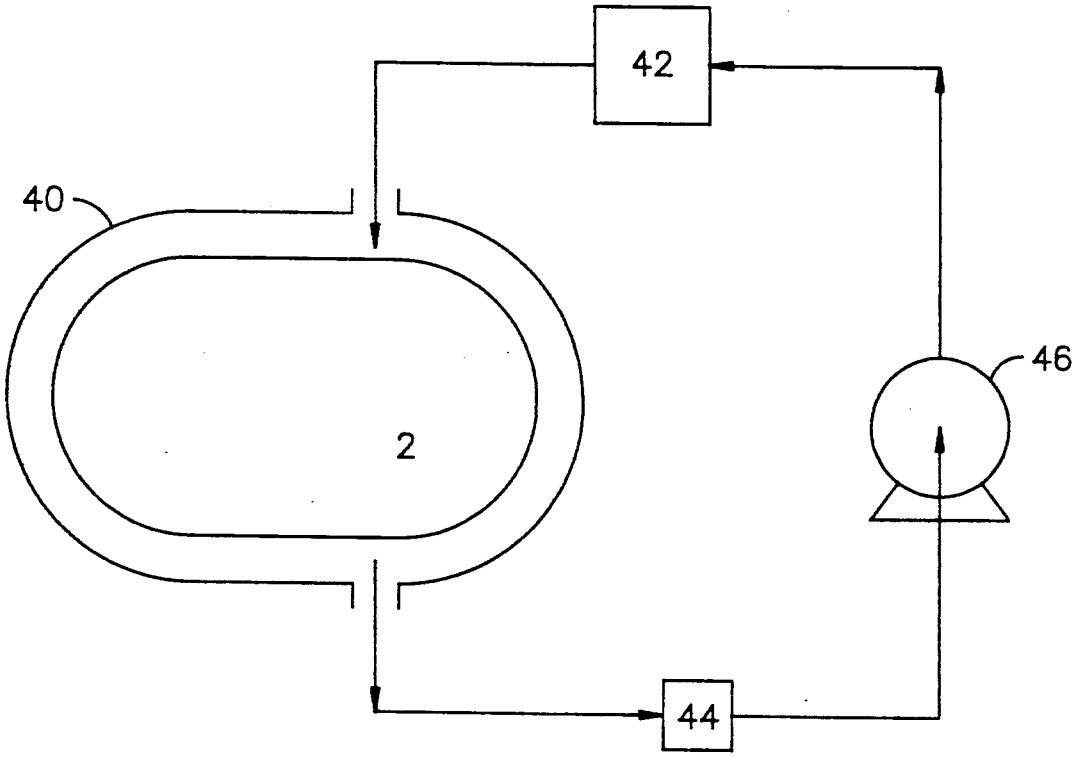
FIG. 2 is a schematic view of a system for recirculating a heat transfer fluid around the outer jacket of a liquid storage tank.

Storage tank 2 can be any vessel which has at least one outlet, at least one inlet and which is capable of storing a foamable liquid. In geographical areas where ambient temperatures are low enough to freeze the foamable liquid inside the foam generating apparatus, or whenever it should become necessary to maintain the foamable liquid at a controlled temperature, it is desirable to equip storage tank 2 with an external jacket 40, as shown in FIG. 2. Jacket 40 allows for the circulation of a heat transfer fluid through the area between jacket 40 and the external surface of storage tank 2. The heat transfer fluid may be heated by heater 42 and circulated by pump 46 through jacket 40, to maintain the foamable liquid at an elevated temperature in the apparatus. A temperature-activated switch 44 may be employed in the exit stream of jacket 40 for regulating the operation of heater 42. That is, switch 44 may be employed to turn on and off heater 42 in order to maintain the temperature at a predetermined level, e.g. 80° F. Heater 42 may be, for example, a fuel-fired heater using a fuel such as propane, gasoline, or diesel fuel, or an electric heater.

Again referring to FIG. 1, check valve 30, connected in the flow path between tank 2 and pump 12, permits the flow of the foamable liquid from tank 2 to high pressure pump 12 while preventing flow in the reverse direction.

High pressure pump 12 delivers foamable liquid from tank 2 to foam block 16. Pump 12 may be of any type which is capable of delivering a foamable liquid at a high pressure, desirably at approximately 500 psi. Furthermore, in order to prevent pump 12 from freezing, foamable liquid must be able to flow through pump 12 when pump 12 is not in operation. A preferred high pressure pump, having the desired characteristics is a model 6020 pump, manufactured by CAT Pump Corporation of Minneapolis, Minn.

During production of foam, approximately 10% of the volumetric flow of the foamable liquid exiting high pressure pump 12 is received by pressure regulator 14. The foamable liquid received by regulator 14 is returned to tank 2 through return path 8 and through check valve 36.

The remaining 90% of the volumetric flow of the foamable liquid exiting pump 12 is received by three-way valve 32. During normal operation of the foam generating apparatus, a selectable position of valve 32 permits the flow of the foamable liquid from pump 12 to foam block 16 while preventing the foamable liquid from flowing to tank 2 via return path 8. During storage, or non-operation, of the apparatus, another selectable position of valve 32 prevents the flow of the foamable liquid from pump 12 to foam block 16 while permitting the foamable liquid to flow to tank 2 through the return stream. Typically, valve 32 is any conventional three-way valve, and may be manually or automatically controlled.

Foam block 16 combines compressed air (at approximately 100 psi) from compressor 18 with the foamable liquid delivered by pump 12 through valve 32 by forcing the foamable liquid through a restricted passage at very high pressure (approximately 500 psi) and by injecting air into the liquid downstream from the restriction. The restriction is sufficiently narrow to produce a high velocity flow of the dispersion so that the initiation of foam generation takes place just past the restriction by the flashing of some of the dispersion medium. Continued foam generation takes place in a converging line further downstream from the restricted passage where the air is injected. Preferably, foam block 16 is a foam block of the kind described in U.S. Pat. No. 4,474,680 to Kroll. Product foam generated in foam block 16 is then delivered to delivery line 50 where the foam exits the apparatus for use. Generally, the product foam is delivered through nozzles (not shown) attached to the delivery line.

When the product foam is prevented from flowing through delivery line 50 due to blockage either from a closed nozzle or from a kink in the line, the hydraulic pressure in foam block 16 increases due to the continuous pumping operation of pump 12. When the hydraulic pressure reaches a predetermined level, check valve 38 closes thereby preventing the further flow of compressed air to foam block 16. Pressure relief valve 34 is set to open at a pressure slightly higher than the pressure at which check valve 38 closes. Valve 34 opens, thereby enabling the foamable liquid to flow through foam block 16, through relief valve 34 and directly back to tank 2 via the return line 8. When the hydraulic pressure falls upon the opening of delivery line 50, pressure relief valve 34 closes, preventing the foamable liquid from returning to tank 2, and valve 38 is reopened to allow compressed air to enter foam block 16.

During storage, recirculation pump 10, which is normally inactive, is activated and high pressure pump 12 which is normally active, is inactivated. Pump 10 delivers the foamable liquid from tank 2 through the inner components of pump 12 in order to prevent the inactivated pump 12 from freezing in extremely cold outdoor environments. Valve 32 is switched to cut off flow of foamable liquid to the foam block and to direct the foamable liquid from pump 12 to line 8 instead. Therefore, during storage, the foamable liquid is recirculated by pump 10, through the inactivated high pressure pump 12 and valve 32, and is then returned to tank 2 via return path 8 and check valve 36.

Figure 3:
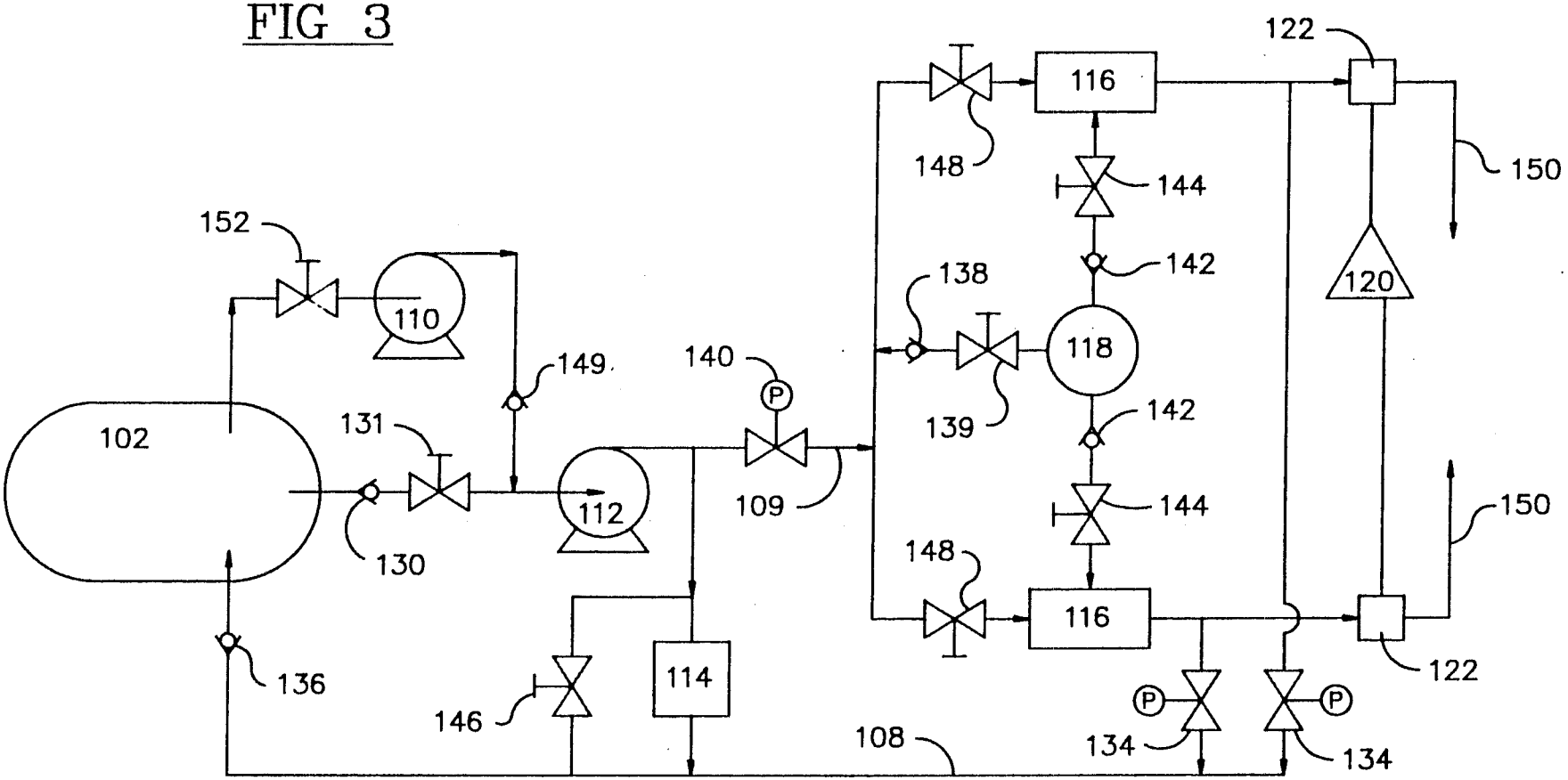
FIG. 3 is a schematic view of a second embodiment of the foam generating apparatus of the invention.

Another embodiment of the invention is shown in FIG. 3, comprising storage tank 102, recirculation pump 110, high pressure pump 112, pressure regulator 114, foam blocks 116, air compressor 118, and solenoid valve 120. In general, storage tank 102, recirculation pump 110, high pressure pump 112, pressure regulator 114, foam blocks 116, and air compressor 118 can be identical to the corresponding components in FIG. 1.

The foamable liquid is pumped from tank 102 through check valve 130 and valve 131 by high pressure pump 112. Preferably, valve 131 is a ball valve, but any type of valve capable of regulating the volumetric flow of the foamable liquid will work. Further, the operation of valve 131 may be manually or automatically controlled. Approximately 10% of the volume of the foamable liquid exiting pump 112 is received by pressure regulator 114. In this embodiment, pressure regulator 114 is equipped with bypass valve 146 which may be a manually or automatically controlled ball valve. Bypass valve 146 remains closed during normal operation of the apparatus and is opened during a storage condition which will be later described.

The remainder of approximately 90% of the volume of the foamable liquid exiting pump 112 flows through relief valve 140 whenever the hydraulic pressure in the apparatus is greater than a predetermined level, e.g. 100 psi. However, relief valve 140 closes whenever the hydraulic pressure is less than the predetermined level, as for example during the storage condition later described.

After the foamable liquid flows through valve 140, it is split into two streams and fed into two foam blocks 116. However, any number of streams and any number of foam blocks may be used. The flow of the foamable liquid entering each foam block 116 is regulated by a manually or automatically controlled ball valve 148. 5 Compressed air at approximately 100 psi is supplied from air compressor 118 to each foam block 116 where it is combined with the foamable liquid to produce the product foam. The flow of compressed air to each foam block 116 is regulated by a system of valves which are connected in series. As shown in FIG. 3, check valve 142 ensures that the direction of flow of compressed air is toward foam block 116 only and not in the reverse direction. Located downstream from check valve 142 is manually or automatically controlled valve 144.

Again referring to FIG. 3, the foam product produced by foam blocks 116 is continuously delivered to the respective delivery lines 150 where it exits the apparatus and is available for use. In order to regulate the flow of the foam product to delivery lines 150, pneumatic valves 122 are connected in-line between foam blocks 116 and delivery lines 150. Pneumatic valves 122 are controlled by air supplied through solenoid valve 120. Solenoid valve 120 is electrically controlled by a human operator through a switch (not shown). The opening of solenoid valve 120 delivers air to pneumatic valves 122 thereby causing valves 122 to close preventing the flow of the foam product to delivery lines 150.

When pneumatic valves 122 are closed, the hydraulic pressure in the apparatus increases. When the hydraulic pressure reaches a predetermined level (e.g. 140 psi), valves 144 close preventing the further flow of compressed air into foam blocks 116. This prevents the further production of foam. At the same time, pressure relief valves 134, connected to the outlet of foam blocks 116, are opened enabling the return of the unused foamable liquid from foam blocks 116 to tank 102 via return line 108.

The operation of the embodiment of FIG. 3 takes place as follows. During normal operation, valve 131 is opened while valves 139, 146 and 152 are closed. Pump 112 delivers approximately 10% of the volume of the foamable liquid pumped from tank 2 through pressure regulator 114, which regulates the hydraulic pressure in the apparatus, e.g. at approximately 500 psi. The foamable liquid flowing through pressure regulator 114 is returned to tank 102 through return line 108. The remaining 90% of the volume of the flow of the foamable liquid exiting pump 112 flows through pressure relief valve 140 which will open at hydraulic pressures greater than 100 psi. The foamable liquid is then divided into two streams and flows through open valves 148 and into foam blocks 116. Valves 144 are opened to permit compressed air from air compressor 118 to enter foam blocks 116, and the foam product is generated, as in the description of the preferred embodiment. During normal operation, solenoid valve 120 is closed to prevent the transfer of air to pneumatic valves 122. This allows the free transfer of the foam product from foam blocks 116 to delivery lines 150, where the product foam becomes available for use. When the transfer of foam to delivery hoses 150 is not desired, pneumatic valves 122 are closed by the opening of solenoid valve 120. When the hydraulic pressure attains a predetermined level, e.g. 140 psi, valves 144 are closed and valves 134 are opened thereby enabling the unused foamable liquid to be returned to tank 102 via return line 108.

During a storage, or non-operation, condition, valve 131 and valves 144 are closed while valves 146 and 152 are opened. High pressure pump 112 is inactivated while recirculating pump 110 is activated. Recirculation pump 110 is connected to a second outlet of tank 102 through valve 152. Valve 152 regulates the volume of the foamable liquid flowing to pump 110, and may be manually or automatically controlled. The foamable liquid is pumped by recirculation pump 110 from tank 102 through check valve 149 and through the inner portions of the inactivated high pressure pump 112. Because pump 110 is not capable of generating hydraulic pressure sufficient to open pressure relief valve 140, valve 140 remains closed. Therefore, all of the foamable liquid exiting pump 112 flows to pressure regulator 114. Bypass valve 146 is opened allowing the foamable liquid to be diverted around pressure regulator 114, where it is then returned to tank 102. In this manner, foamable liquid is continuously pumped through high pressure pump 112 in order to prevent the liquid from freezing in pump 112 when exposed to extremely cold environments. The recirculation of foamable liquid through pump 112 also eliminates the need to purge pump 112 with air which can cause air to become trapped within the pump thereby creating the risk of pump cavitation upon start-up. Furthermore, by using a smaller recirculating pump 110 to recirculate the foamable liquid through the system rather than using high pressure pump 112, there is a reduction in the amount of wear and tear on high pressure pump 112.

The foamable liquid in tank 102 may be heated with a heat transfer fluid circulated through an external jacket by a recirculating system similar to that shown in FIG. 2.

During a storage condition, compressed air from air compressor 118 may be used to purge the components and the liquid flow streams which are located downstream from high pressure pump 112. The flow of compressed air to line 109 takes place through check valve 138 and is regulated by valve 139. Check valve 138 enables air to be delivered into liquid line 109 while preventing the flow of the foamable liquid from relief valve 140 into air compressor 118. Valve 139 is opened, enabling air to enter line 109 downstream from pressure relief valve 140. The air is used to purge all of the remaining foamable liquid from the streams leading to and including foam blocks 116 and delivery lines 150. Air is never allowed to enter return line 108 leading to tank 102 since air in tank 102 would cause the undesirable generation of foam in tank 102. Therefore, valves 134 are used to prevent air from entering the return line.

Various other modifications will occur to those having ordinary skill in the art and may be made without departing from the scope of the invention as defined in the following claims.

We claim:

1. A foam generating apparatus, comprising:
- a storage tank for storing a foamable liquid;
- means for supplying air under pressure;
- means for combining air from said supplying means with said foamable liquid to produce a foam product;
- pumping means for delivering said foamable liquid from said tank to said combining means;
- delivery means, connected to said combining means, for permitting foam to exit said apparatus;
- means providing a return path connected to said storage tank;
- valve means having a first selectable position for permitting the flow of said foamable liquid from said pumping means to said combining means, and having a second selectable position for preventing the flow of said foamable liquid from said pumping means to said combining means and for permitting the flow of said foamable liquid from said pumping means through said return path to said tank;
- circulation pump means for pumping said foamable liquid from said tank through said pumping means and through said return path while said pumping means is not operating.

2. A foam generating apparatus according to claim 1, further comprising means for circulating a heat transfer fluid in a heat-exchange relationship with said tank.

3. A foam generating apparatus according to claim 1, wherein said valve means is a three-way valve.

4. A foam generating apparatus according to claim 1, further comprising second valve means for preventing the transfer of air from said air supplying means to said combining means, and for permitting the transfer of said foamable liquid from said combining means to said tank, when the hydraulic pressure in said delivery means exceeds a predetermined pressure level.

5. A system for generating a foam product wherein during a normal working condition, a foamable liquid is used to produce said foam; and during a storage condition, said foam is not produced and said foamable liquid is recirculated in said system, comprising:
- a storage tank for storing said foamable liquid;
- means for supplying air under pressure;

means for combining air from said air supplying means with said foamable liquid to produce said foam product;

pumping means, having a first and a second outlet, for transferring said foamable liquid from said tank through said first outlet of said pumping means to said combining means;

delivery means connected to said combining means for permitting said foam product to exit said system;

pressure regulating means connected to said second output of said pumping means for regulating and maintaining hydraulic pressure in said system at a predetermined first level, said pressure regulating means having an output connected to said tank for returning the foamable liquid entering said pressure regulating means to said tank;

first valve means provided in said first outlet of said pumping means for permitting the transfer of said foamable liquid from said pumping means to said combining means when the hydraulic pressure in said system exceeds a predetermined second level, and for preventing said transfer of said foamable liquid when the hydraulic pressure is less than said second level, said second pressure level being less than said first pressure level;

bypass means connected between said second outlet of said pumping means and said tank for permitting the flow of said foamable liquid from said pumping means to said tank when said hydraulic pressure in said system is less than said second pressure level; and recirculation pump means for recirculating said foamable liquid from said tank through said pumping means, through said bypass means, and back to said tank when said hydraulic pressure in said system is less than said second pressure level.

6. A foam generating system according to claim 5, further comprising second valve means for preventing the transfer of air from said air supplying means to said combining means, and for permitting the transfer of said foamable liquid from said combining means to said tank, when the hydraulic pressure in said delivery means exceeds a predetermined third pressure level, said third pressure level being less than said first pressure level.

7. A foam generating system according to claim 5, wherein said bypass means includes a manually-operable valve.

8. A foam generating system according to claim 5, wherein said air supplying means is further connected to said first output line of said pumping means for introducing air into said first output line downstream from said first valve means during said storage condition for passage of air through said combining means and said delivery means.

9. A foam generating system according to claim 5, wherein said circulation pump means includes a manually-operable valve and a pump, said pump generating hydraulic pressure in said system which is less than said second pressure level.

10. A foam generating system according to claim 5, wherein during a storage condition, said hydraulic pressure is less than said second pressure level.

11. A foam generating system according to claim 5, further comprising means for circulating a heat transfer fluid through an external jacket of said tank.

* * * * *